US005964255A

United States Patent [19]

Schmidt

[11] Patent Number: 5,964,255

[45] Date of Patent: Oct. 12, 1999

[54] VACUUM SEALED APPARATUS FOR STORING FOODSTUFFS

[75] Inventor: George Schmidt, Douglaston, N.Y.

[73] Assignee: M. Kamenstein, Inc.

[21] Appl. No.: 08/957,199

[22] Filed: Oct. 24, 1997

[51] Int. Cl.[6] ..... B65B 31/04

[52] U.S. Cl. ..... 141/65; 99/472; 220/212; 215/228; 53/88

[58] Field of Search ..... 141/65; 99/472; 220/212; 215/228; 53/88

[56] References Cited

U.S. PATENT DOCUMENTS

| | | | |
|---|---|---|---|
| 3,722,557 | 3/1973 | Huggins | 141/65 |
| 4,051,971 | 10/1977 | Saleri et al. | 215/228 |
| 5,142,970 | 9/1992 | ErkenBrack | 99/472 |
| 5,406,992 | 4/1995 | Miramon | 141/65 |
| 5,692,632 | 12/1997 | Hsieh et al. | 220/212 |
| 5,765,608 | 6/1998 | Kristen | 141/65 |
| 5,803,282 | 9/1998 | Chen et al. | 215/228 |
| 5,806,575 | 9/1998 | Tsay | 141/65 |

OTHER PUBLICATIONS

"Owner's Manual" for Celedon Vacumizer, Celedon, Oakland, California. Publication date not known, but prior to Oct. 24, 1997.

*Primary Examiner*—J. Casimer Jacyna
*Attorney, Agent, or Firm*—Robert A. Koons, Jr.; James W. Bolcsak; Pepper Hamilton LLP

[57] ABSTRACT

A vacuum sealed apparatus for storing foodstuffs is disclosed which comprises a battery powered vacuum pump integral with the container, for portable use in the preservation of foods. More particularly, the invention is a rigid container fitted with a battery operated vacuum pump in its base, and a lid for admitting food to be stored in partial vacuum.

5 Claims, 8 Drawing Sheets

VACUUM SEALED APPARATUS FOR STORING FOODSTUFFS

FIELD OF THE INVENTION

The present invention relates generally to devices for storing foodstuffs, where the device is suitable for securely storing foodstuffs while maintaining the freshness of the foodstuffs.

BACKGROUND OF THE INVENTION

The freshness of many foodstuffs is preserved by storing these foodstuffs in sealed containers. The spoilage of the foodstuffs is accelerated by exposure to air, either through the effects of moisture in air, or the oxidative effects of atmospheric oxygen. Food is widely stored before use then in closed, tightly sealed containers in an effort to preserve and extend the useful life of food. Various sizes and shapes of sealed containers are widely used to contain and store food away from the components of air which cause oxidation and moisture spoilage. These sealed containers are normally used however as simple closed vessels for holding the food away from exposure to air. When food is stored in typical sealed containers there is usually accompanying air which is trapped within the sealed container with any food contained therein. This accompanying air can still have detrimental effects on the enclosed food. There would be demand then for storage containers which can be sealed around food, and which are configured to allow the evacuation of the accompanying air from the space around the enclosed food. To be of use to the average consumer such a container should also provide means for the evacuation of the container, and this means for evacuation should be convenient to use.

An attempt to provide for storage of food under vacuum with a system that is affordable for the average consumer may be found in U.S. Pat. No. 5,142,970 to ErkenBrack. The storage system described therein used a vacuum pump to evacuate a storage container. The mode of operation of the vacuum pump is by manually applying external force to the body of the pump, or squeezing it. This has the disadvantage of being difficult to operate by the elderly, or disabled and of being time consuming to operate.

Another attempt to provide a convenient vacuum container for consumer use is the "Celedon™ Vacumizer". This container system uses separate food containers and vacuum pumps. For use of this system food is placed in a container and the container is taken to the vacuum pump, which is powered by household line current. After removal of food from the container the reuse of the container requires that the container be returned to the location of the vacuum pump. The reestablishment of a vacuum inside the containers of this system may be carried out only where the vacuum pump is located, which must be in proximity to an electrical outlet. This system has the disadvantage of lacking portability. It would be difficult to use out of doors or in homes with a shortage of electrical outlets. For example, it could not be used on picnics, inside many home pantries or in many basements.

SUMMARY OF THE INVENTION

The present invention is directed to an apparatus for storing foodstuffs where the food is held in a sealed hard walled container which has as an integral part, a battery powered vacuum pump. This vacuum pump may be used to draw air from the food storage container portion of the apparatus, leaving the contained foodstuffs in a partial vacuum. The foodstuffs stored in the container portion of the apparatus of the invention will then be exposed to very little air, and to the spoiling effects of air. The container portion of the invention may be sized to accommodate a variety of kinds of foodstuffs as would be commonly found in the household kitchen. Furthermore, the container portion of the invention can be formed in shapes and configurations suited to holding loose items of foodstuffs, foodstuffs in supplemental containers such as canisters, or on trays or other holders of various sorts.

The present invention is used by placing one or more items of foodstuff into a container of the invention, closing an airtight lid on the container to enclose the foodstuff, and evacuating air from the container using the vacuum pump integral with the container. The evacuation of air is accomplished by depressing a switch on the exterior of the invention's container to supply power from the vacuum pump's battery power source to the vacuum pump. The user releases the switch after exhausting air from the container, and airtight valves close to maintain the vacuum within the container. Foodstuff so contained will then benefit from separation from the spoiling effects of air until a release button is depressed on the exterior of the container. This release button is linked to an air inlet valve which opens and releases air into the container. When atmospheric pressure is restored to the interior of the invention's container, the lid of the container may be opened and the contents removed. The user of the present invention may repeat this procedure as desired. For convenience, the user may use trays, or supplemental containers such as canisters, to organize and hold different foods in place inside the container of the invention without deviating from the spirit or teaching of the invention. The practice of the invention will be apparent from the examples disclosed below as embodiments.

OBJECTS OF THE INVENTION

It is an object of the present invention to provide a container for consumers which will allow the storage of foodstuff away from the harmful effects of exposure to air.

It is a further object of the present invention to provide a container for consumers which will allow such storage while allowing a vacuum to be created when the invention's container is at any location in the kitchen, home or outside; even if that location is remote from an electrical outlet.

It is another object of the present invention to provide a container for consumers which will allow the storage of foodstuff in a vacuum where the vacuum is created by action of an electric vacuum pump, making the evacuation of the air from the storage container a convenient and quick process requiring a minimum of physical effort for the user.

It is also an object of the present invention to provide for the vacuum storage of foodstuff in containers of various shapes and sizes which are suited to the efficient storage of different types of foods.

These and other objects of the invention will become apparent to one skilled in the art from the following more detailed disclosure of the invention.

DESCRIPTION OF THE DRAWINGS

All figures are schematic and are not drawn to scale. If a given feature is shown in more than one figure then the same numeral is used to identify the feature in all the figures in which it appears.

DETAILED DESCRIPTION OF THE INVENTION

Figure 1:
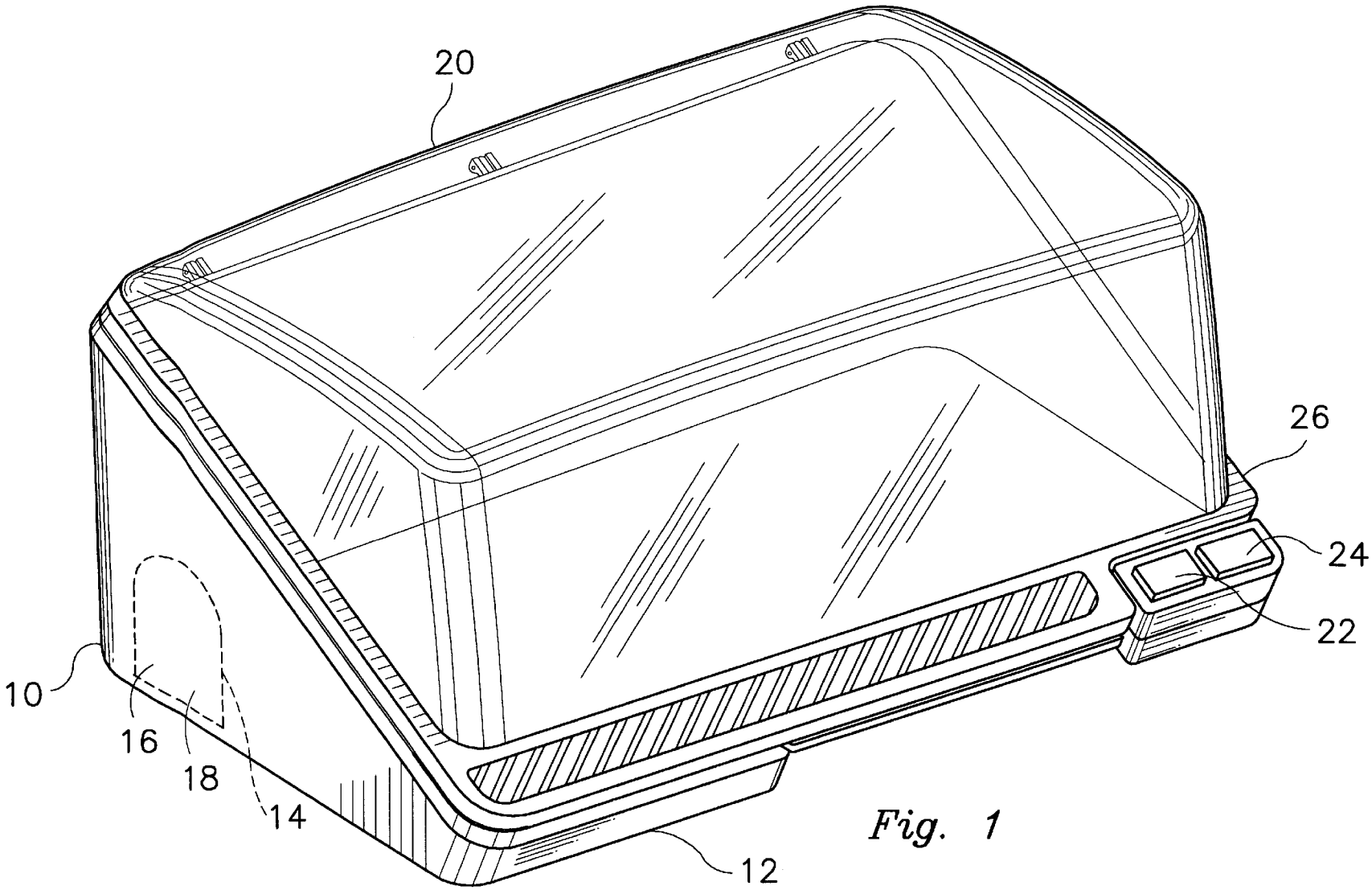
FIG. 1 is an illustration in perspective of a first embodiment of the present invention, a bread box integral with a battery operated vacuum pump, showing the vacuum pump button, the button for release of the vacuum, the hinged lid and a vacuum pump.
Figure 2:
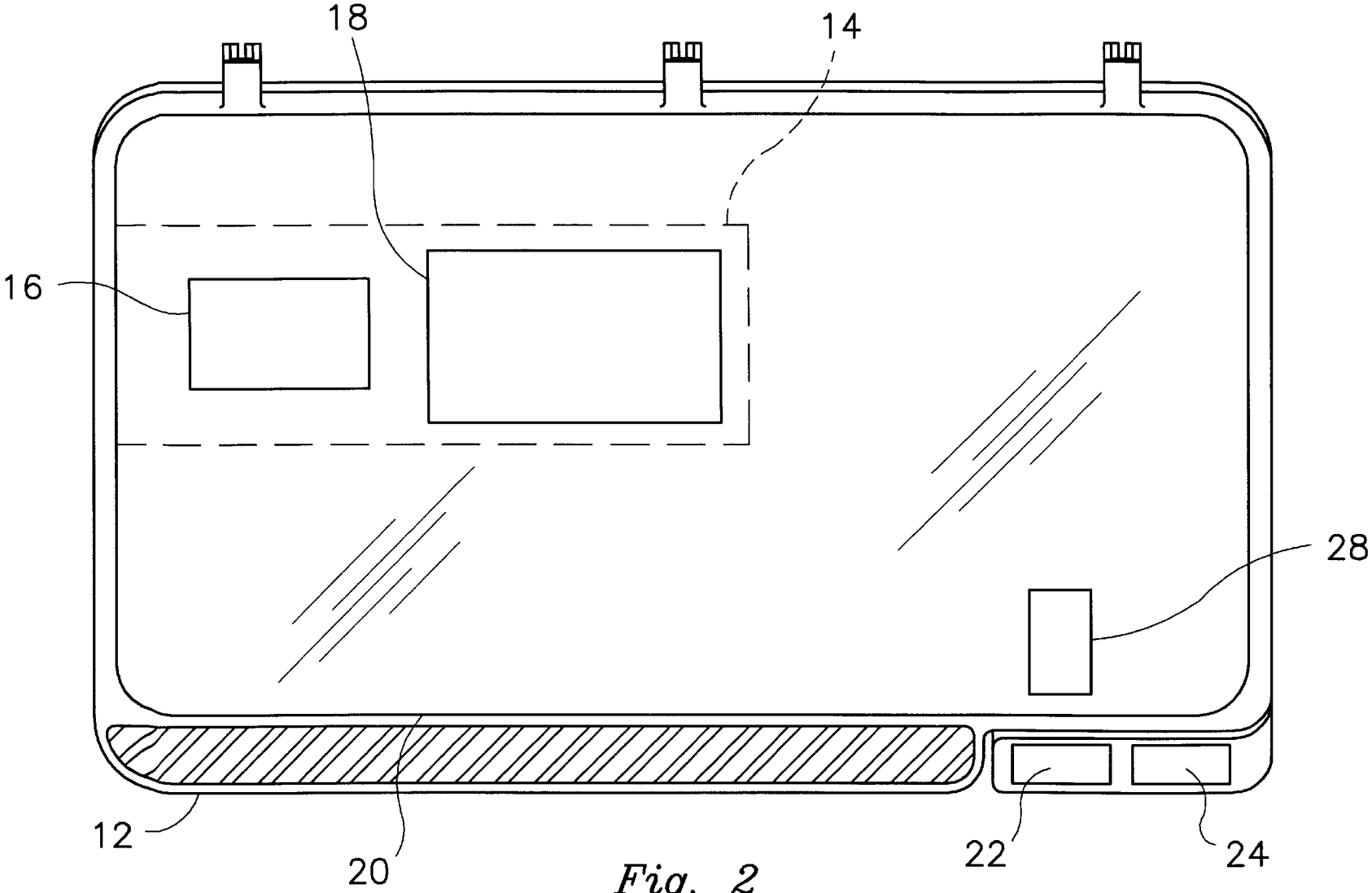
FIG. 2 is a plan view of the first embodiment of the present invention, showing the hinged lid and vacuum pump.
Figure 3:
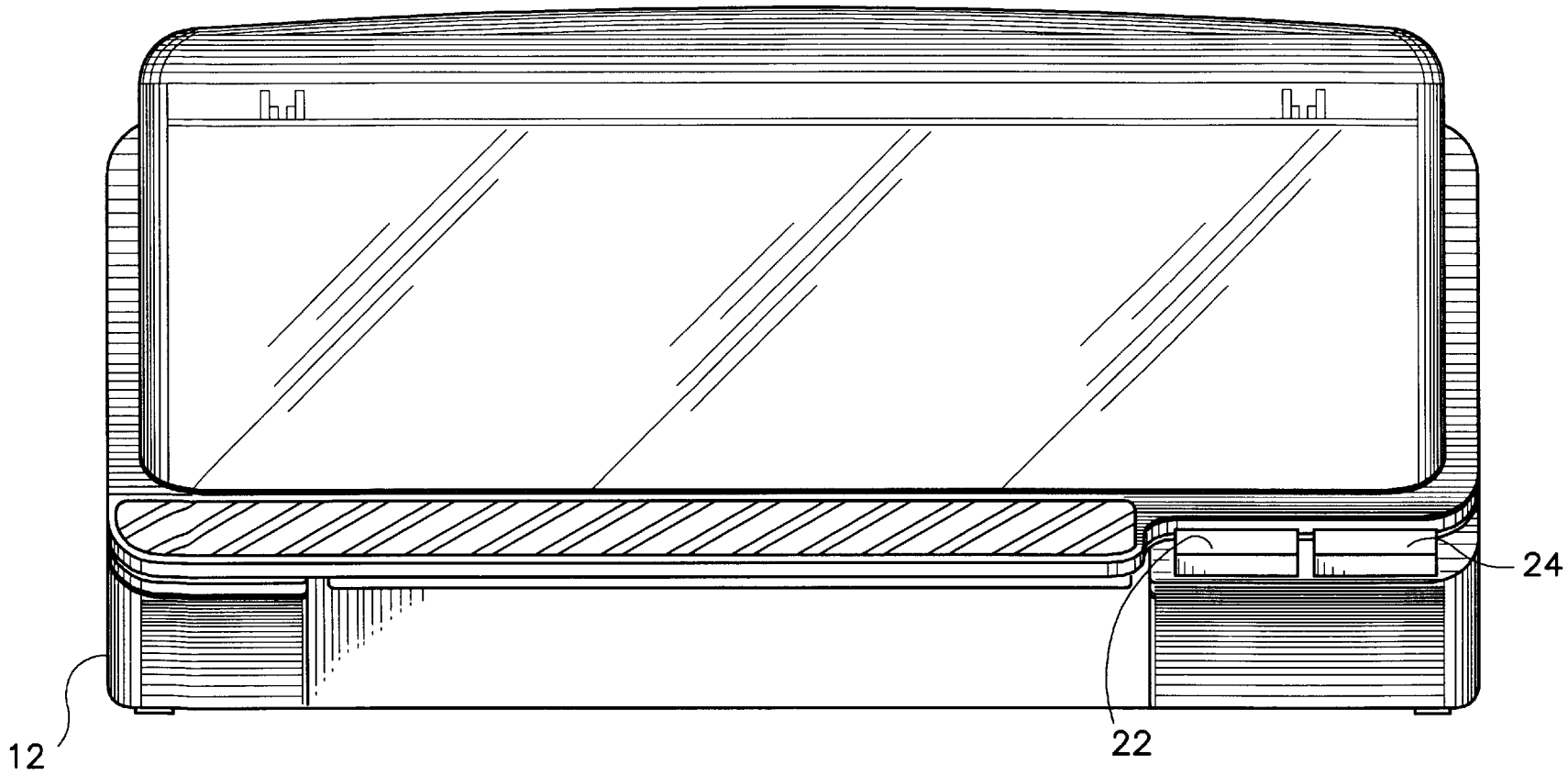
FIG. 3 is a front view of the first embodiment.
Figure 4:
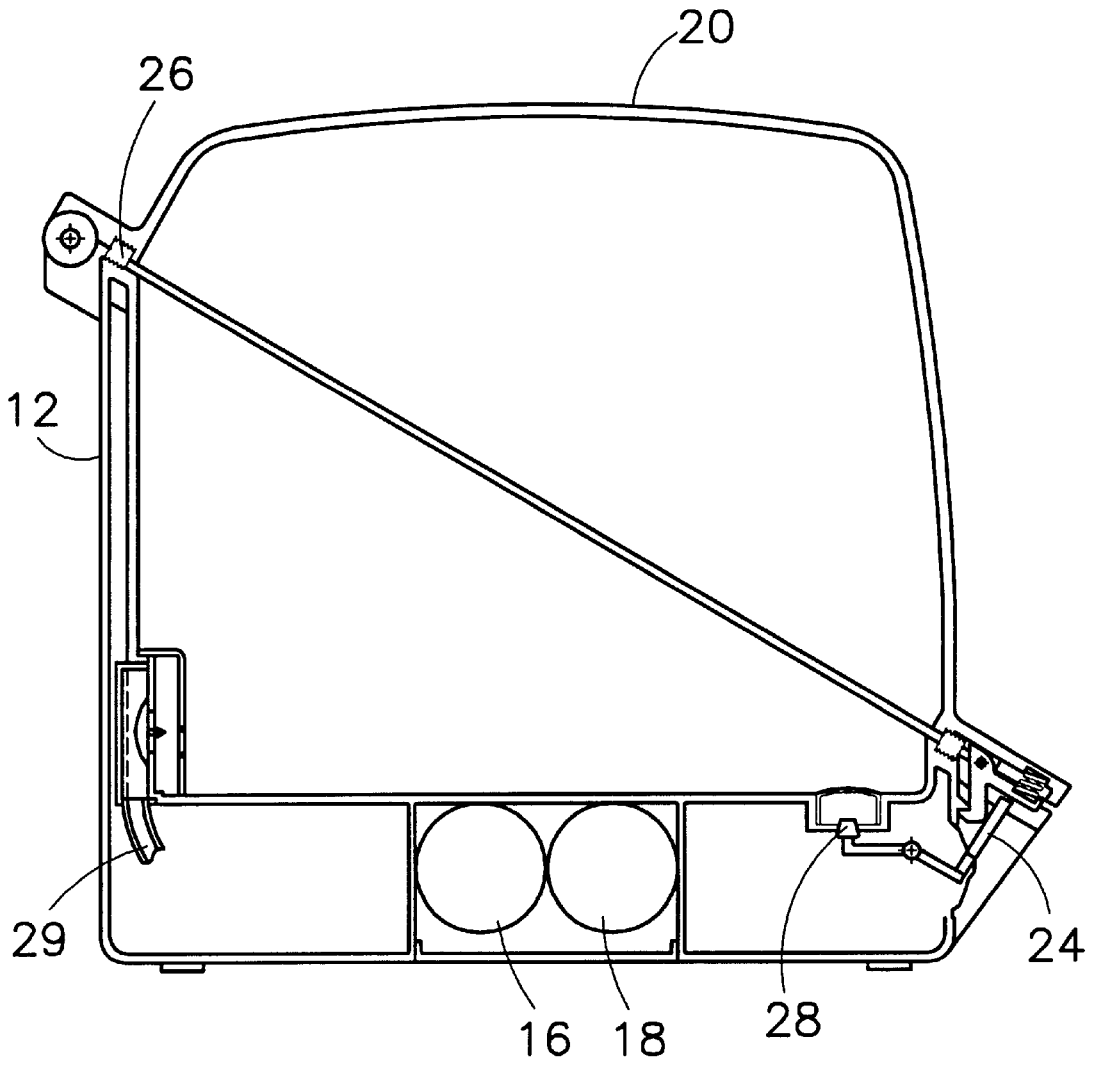
FIG. 4 is a side view of the first embodiment.

The present invention relates to an apparatus for storing food in partial vacuum.

With reference to FIG. 1 through FIG. 4, the depiction of a first embodiment of the invention, for use as a bread box 10 or the like, the invention is depicted with a base 12 having a cavity 14 sized to receive a vacuum pump 16 and its associated battery power supply 18. The vacuum pump could be of several types but is preferred to be a piston type vacuum pump. The bread box is fitted with a hinged lid 20 which is adapted to mate with the base 12 at its periphery where a gasket 26 is provided for establishing a vacuum tight seal. On the front of the bread box base may be seen buttons 22 and 24, buttons for operating the integral vacuum pump and for operating a vacuum release valve 28 on the underside of the base. A valve 28 is connected between the cavity of the apparatus for holding food and a tube 29 which connects this valve to the battery operated vacuum pump. The apparatus is used by placing bread or another foodstuff into the bread box, closing the hinged lid to allow the gasket to engage the peripheries of both the upper base and the lid, and depressing the button for controlling the vacuum pump. The air inside the invention is evacuated to any extent chosen by the operator. After releasing the control button the vacuum will be maintained inside the apparatus for keeping the bread or other foodstuff fresh. The vacuum is released by depressing the vacuum release button, engaged with a vacuum release valve. This valve is preferably of the type known as an umbrella valve. Release of the vacuum by letting air back into the apparatus then allows the bread or other foodstuff to be retrieved from the apparatus.

Figure 5:
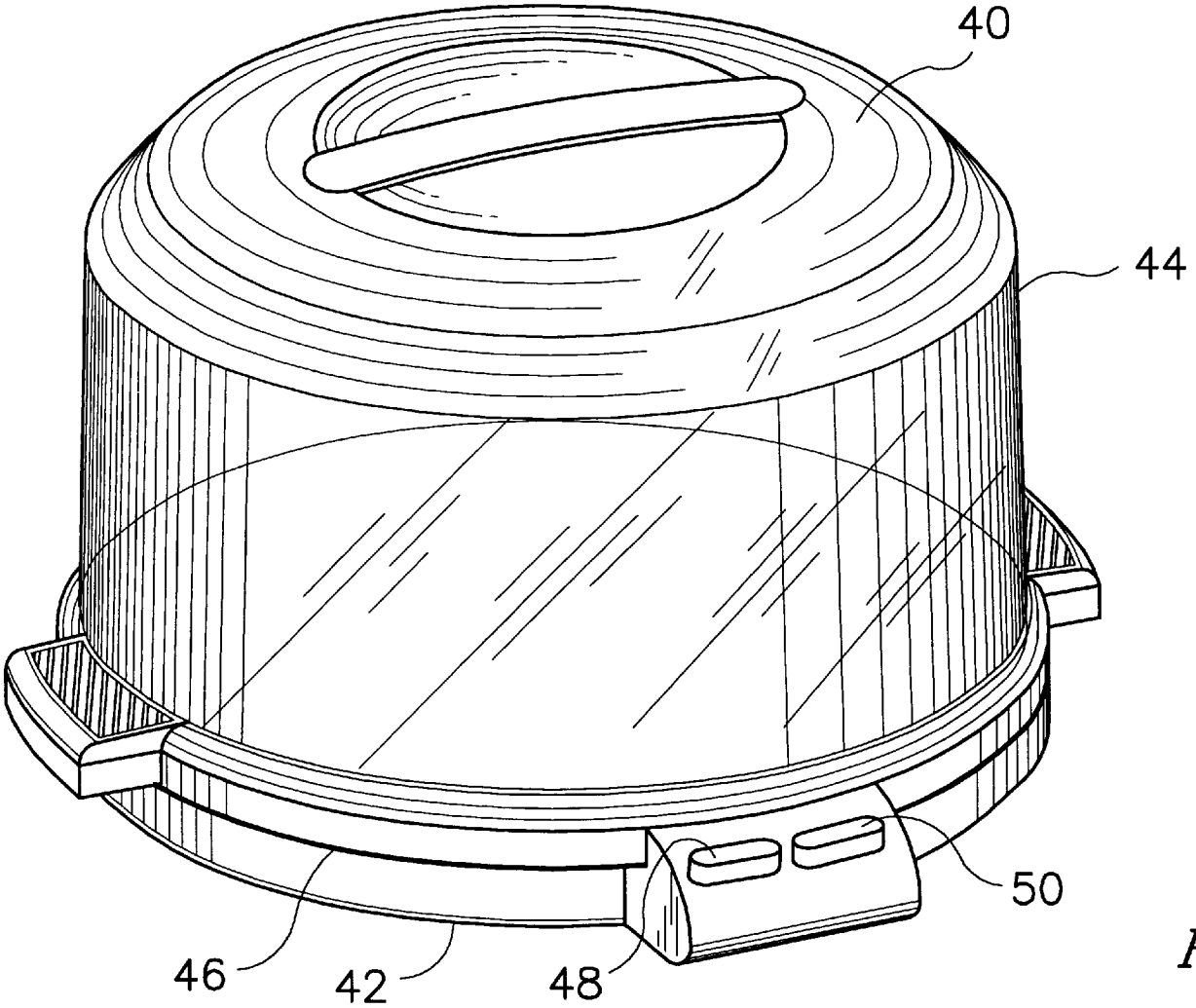
FIG. 5 is perspective view of a second embodiment of the present invention, a cake or fruit saver, integral with a battery operated vacuum pump.
Figure 6:
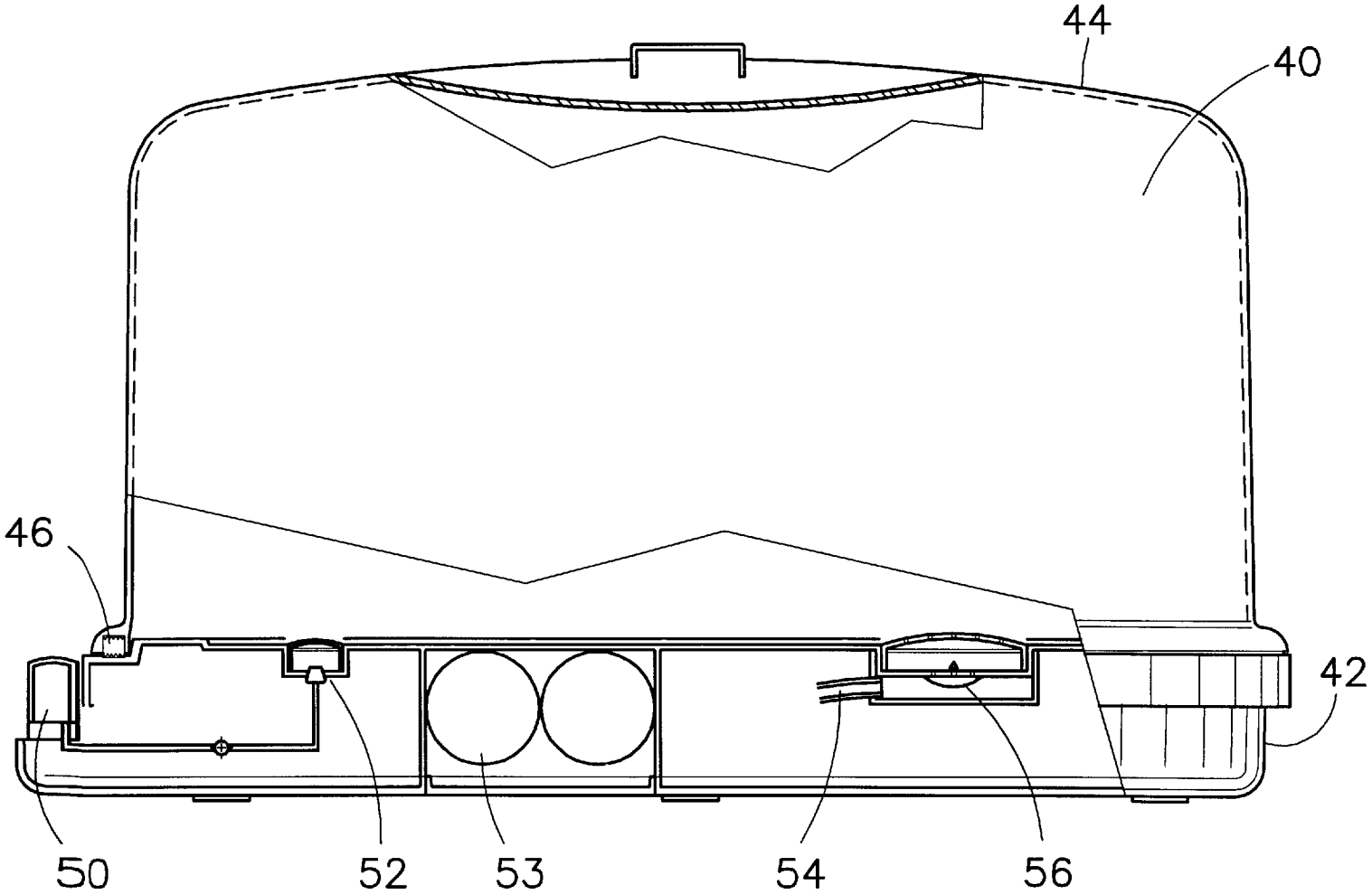
FIG. 6 is a side view of the second embodiment.

A second alternative embodiment 40 of the invention is depicted in FIG. 5 and FIG. 6, which is adapted for use primarily as a cake saver or the like. This embodiment comprises a generally circular base 42, a domed lid 44 adapted for mating with the base at gasket 46, buttons 48 and 50 for operating the vacuum pump 51 contained within the base and for operating the vacuum release valve 52. This embodiment is operated by removing the lid, placing the foodstuff to be stored on an upper surface of the base, covering the base with the lid, taking care to mate the lid and base at the gasket, and depressing the vacuum control button 48 pivotally connected to valve 52. The air within the storage apparatus is evacuated to any desired degree to achieve preservation of the freshness of the food stored within, by pumping from the enclosed space by pump 51 through tube 54 and valve 56. The vacuum may be release by depressing the vacuum release button to return air to the interior of the apparatus. The contained food may then be removed by lifting off the lid from the mated base. It is to be understood that with this type of embodiment of the invention, that food may be placed into the apparatus on plates or trays of various types without deviating from the spirit of the invention.

Figure 7:
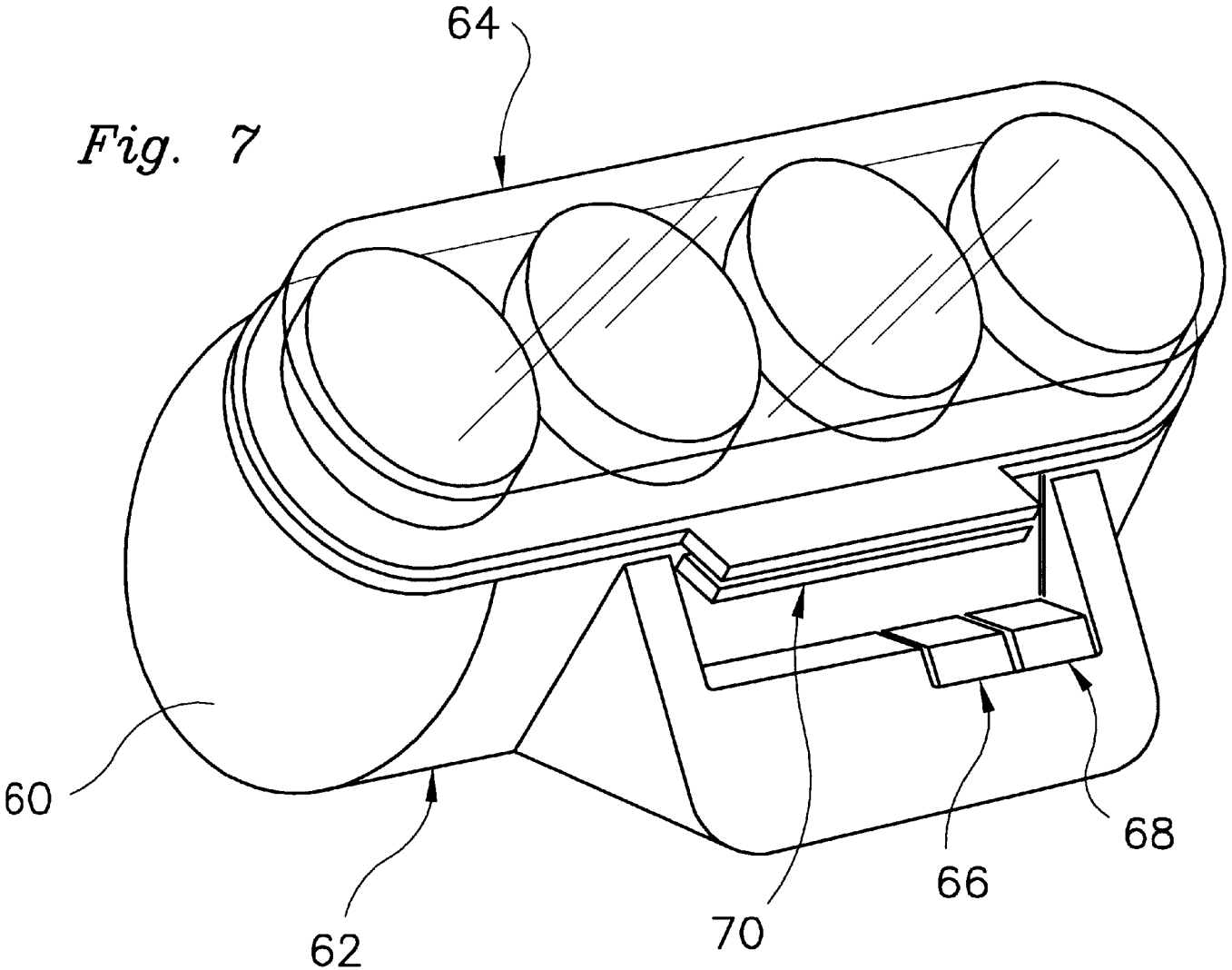
FIG.7 is a perspective view of a third embodiment of the present invention, a storage container for food canisters.
Figure 8A:
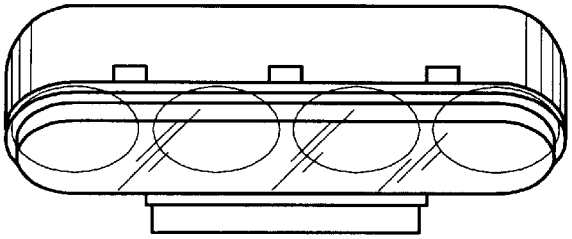
FIG. 8 is an elevation exploded view of the third embodiment, showing the hinged lid for the storage container.
Figure 8B:
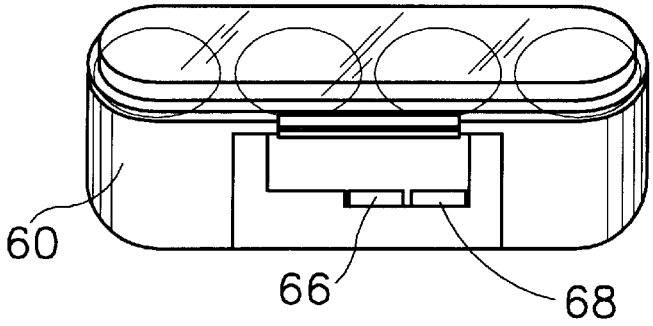
Figure 9:
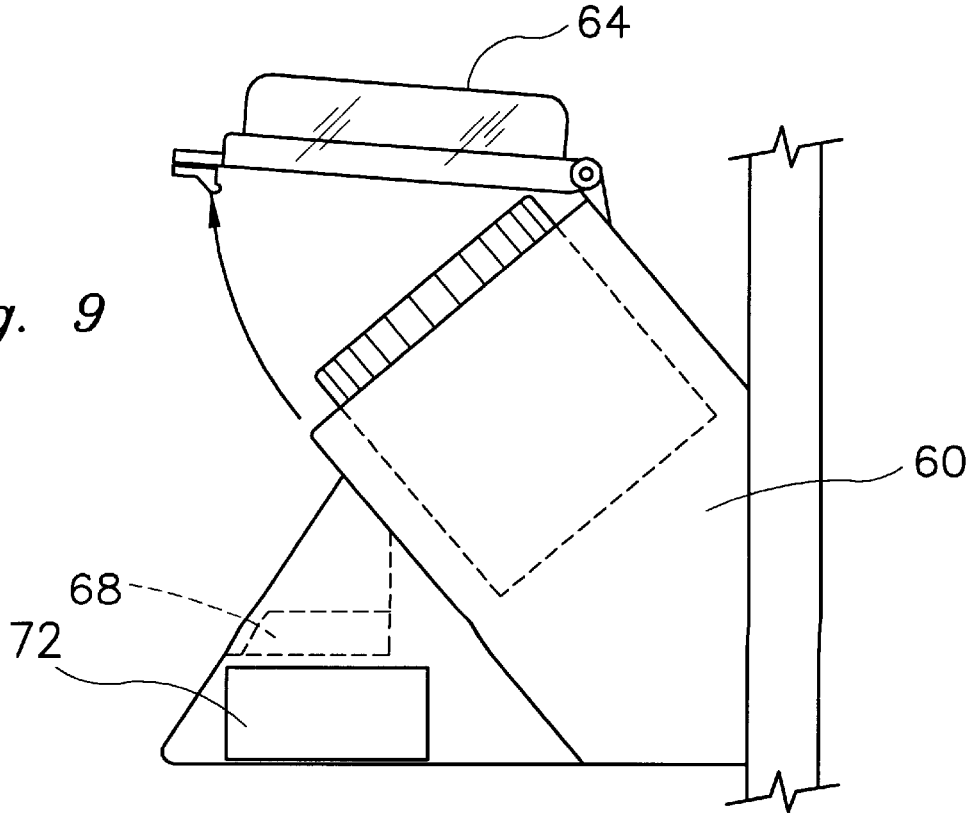
FIG. 9 is a side view of the third embodiment, showing the hinged lid, and the possible wall mounting of the storage container.

A third alternative embodiment of the invention as depicted in FIG. 7 through FIG. 9, is a vacuum sealed canister holder 60. This embodiment comprises a base 62 having a cavity which contains a battery operated vacuum pump 72, a hinged lid 64 disposed above the base and adapted to mate vacuum tight with a periphery of the base at a gasket 70. Mounted on the base are buttons 66 and 68 for controlling the vacuum pump and releasing the vacuum. The base also has a cavity sized to receive food storage canisters such as are commonly used in home kitchens. The operation of this embodiment is similar to the first and second embodiments. This embodiment is used by opening the hinged lid, placing canisters containing food within the food storage cavity, closing the lid, and depressing the button for operating the vacuum pump 66. A desired degree of evacuation of air may be achieved in this manner to suit the operator. The vacuum so obtained is intended to protect the freshness of the food contained within the canisters placed within the base. The vacuum may be released as in the case of the first two embodiments disclosed here to allow access to the contained food.

One skilled in the art will recognize that more than one type of control button may be used to achieve the objects of the invention. What is preferred is the use of the type of control button known as a momentary switch. The vacuum release valve may be of any type which will allow the objects of the invention to be served, but the preferred type is known as an umbrella valve. The parts of the bases and lids for these embodiments are comprised of rigid materials, preferably injection moldable polymers such as a polyacrylic, polyethylene, polypropylene, polyvinylchloride, or copolymers thereof. Optionally, one or more parts may be comprised of glass. The canisters of the third embodiment disclosed may be constructed of materials such as glass, a metal, or a polymer.

The three embodiments described above are all portable devices which may be used distant from electrical outlets, and their use does not require more physical exertion than that for depressing an ordinary button.

It will be seen by those skilled in the art that the vacuum sealed apparatus disclosed herein may be constructed in various ways without deviating from the spirit and scope of the invention. It is intended that all matter contained in the above description and shown in the accompanying drawings shall be interpreted as illustrative and not in any way limiting. It is also to be understood that the following claims are intended to cover all of the generic and specific features of the invention described herein, and all statements of the scope of the invention which, as a matter of language, might be said to fall therebetween.

What is claimed is:

1. An apparatus for storing foodstuffs in partial vacuum, comprising in combination:

a food storage container comprising a base having an interior, an exterior, and a removably engaged lid dimensioned for defining a closed space above the base for food while engaging sufficiently to provide an air tight seal around the closed space;

means for removing air from said container, the means comprising a vacuum pump disposed in the base and operable by battery power, and a switch mounted to the exterior of the base and electrically connected to the vacuum pump for supplying power to the pump when needed;

means for connecting said container to said air removal means, consisting of a passageway for air in fluid communication from the closed space above the base to the vacuum pump; and means for releasing air into said container once air has been removed, the means for releasing air comprising a button mounted to the exterior of the base, the button operatively connected to a valve in fluid communication intermediate the closed space above the base and the exterior of the apparatus.

2. The apparatus of claim 1 wherein the closed space is sized to receive a loaf of bread.

3. The apparatus of claim 2 wherein the lid is a hinged air tight lid.

4. The apparatus of claim 1 wherein the base is a generally flat, generally circular base, and wherein the lid is a detachable dome shaped closure lid adapted for mating to said base.

5. The apparatus of claim 1 wherein the base is sized to receive at least two food canisters within the closed space, and wherein the lid is a hinged lid adapted for mating with said base.

* * * * *